United States Patent [19]

Ushiro

[11] 4,235,262

[45] Nov. 25, 1980

[54] WEFT FEEDING MECHANISM OF A SHUTTLELESS WEAVING LOOM

[75] Inventor: Masayuki Ushiro, Tokyo, Japan

[73] Assignee: Nissan Motor Company, Limited, Yokohama, Japan

[21] Appl. No.: 967,097

[22] Filed: Dec. 7, 1978

[30] Foreign Application Priority Data

Dec. 20, 1977 [JP] Japan ..... 52/152413

[51] Int. Cl.[3] ..... D03D 47/34

[52] U.S. Cl. ..... 139/452; 139/453

[58] Field of Search ..... 139/429, 452, 453

[56] References Cited

U.S. PATENT DOCUMENTS

| | | | |
|---|---|---|---|
| 3,286,738 | 11/1966 | Golobart | 139/453 |
| 3,885,599 | 5/1975 | Mauldsley | 139/452 |
| 3,915,199 | 10/1975 | Kida | 139/452 |
| 3,915,200 | 10/1975 | Morris | 139/453 |
| 4,000,762 | 1/1977 | Mizuno | 139/452 |

*Primary Examiner*—Henry Jaudon

*Attorney, Agent, or Firm*—Robert E. Burns; Emmanuel J. Lobato; Bruce L. Adams

[57] ABSTRACT

Weft feeding mechanism of a shuttleless loom comprises a feed roller driven from a loom shaft, a pressure roller engageable with the feed roller, another roller engageable with the feed roller in accordance with separation of the pressure roller from the feed roller and in gearing connection with the pressure roller, and control means for movement of the pressure roller into and out of engagement with the feed roller in response to a signal indicating insertion of a selected weft, whereby the pressure roller is constantly driven from the feed roller irrespectively of its position engaging with or separating from the feed roller.

8 Claims, 5 Drawing Figures

WEFT FEEDING MECHANISM OF A SHUTTLELESS WEAVING LOOM

BACKGROUND OF THE INVENTION

This invention generally relates to shuttleless weaving looms and more particularly to a mechanism for selecting a weft to be inserted into a shed of warps among a plurality of weft yarns with which is obtained a variegated weft pattern and feeding the selected weft to the weft insertion device by a predetermined length.

In general, the weft feeding mechanism is provided by two frictionally engageable rollers for each of plural weft yarns, one of which, referred to as a feed roller, is driven from any convenient loom shaft. The other, pressure roller is selectively brought into and out of pressure engagement with the feed roller by an appropriate weft selector means in accordance with weft pattern signals carried on a weft pattern card arrangement. In response to a weft pattern signal representing insertion of any weft, the corresponding pressure roller is pressed against the feed roller to grip the weft together with the feed roller, thus driving the measured length of the weft to a weft storage means, which weft is then fed to the weft insertion device. In the absence of this signal, the pressure roller is separated from the feed roller; the weft is released and remains still on the feed roller.

In this type of feed mechanism, rotation of the pressure roller is slowed down or stops in its inoperative position where it is separated from the feed roller. When the pressure roller is again brought into contact with the feed roller, there will thus be a relatively great peripheral speed difference between the two rollers. It follows that the weft yarn rubs against the outer surfaces of both rollers rotating at different speeds, resulting in breakage of thread or fray of filaments in case of a filament yarn. This of course objectionably influences the quality of a cloth woven in the loom with this mechanism.

Several proposals are so far made to avoid or alleviate this inconvenience in the weft feeding mechanism. One example is disclosed in U.S. Pat. No. 3,885,599 filed Oct. 1, 1973 under Ser. No. 402, 276 by Thomas Blackburn Mawdsley et al, in which the two shafts respectively carrying the rollers also carry thereon two pinions concentrically with the rollers. At the position of maximum separation of the rollers, the pinions remain in mesh with each other. In this prior art, accordingly, both rollers can be driven continuously whether supplying weft yarn or not to the storage element.

According to another known example, two pressure rollers are provided on a common shaft, one of which engages with the feed roller while the other is separated from the same. The pressure roller separated from the feed roller is positively driven from the other pressure roller in engagement with the feed roller via a drive transfer means in the form of a pair of rollers engaging respectively the pressure rollers. Thus the pressure roller in the inoperative position can be constantly rotated generally at the same peripheral speed as the pressure roller directly driven by the feed roller.

However, these two examples and others were found impractical for some reasons. For instance, in the first-mentioned example, the pressure roller is driven by the feed roller not directly but by way of the pinions also in its operative position engaging the feed roller. Hence, it is difficult to maintain exactly the same peripheral speed of the two rollers without highly precisely manufactured pinions and rollers. Wear of the rubber-coated outer surfaces of the rollers will accelerate the speed difference thus resulted between the two rollers. Also, an increased bulk and mounting space is taken, particularly in the latter example, for mounting the two pressure rollers and correspondingly two drive transfer rollers. Also the drive transfer member mounted above the pressure rollers will be a bar to handling the thread by the loom operator in the neighbourhood of the feed mechanism.

SUMMARY OF THE INVENTION

It is therefore a primary object of the invention to provide an improved weft selecting and feeding mechanism of the afore described character which feeds the selected weft yarn to the warp shed without the defects as mentioned above for preparing a cloth of excellent quality.

Another object of the invention is to provide a simple and compact drive transfer means for a weft feeding mechanism of the aforedescribed character, via which the drive of a feed roller is transmitted to a pressure roller in a position separated from the feed roller for rotation generally at the same peripheral speed as in its operative position engaging the feed roller.

Still another object of the invention is to provide an improved weft feeding mechanism of the aforedescribed character which comprises, besides pressure roller and feed roller, a third roller adapted to be brought into pressure engagement with the feed roller in cooperation with separation of the pressure roller from the feed roller and a gearing for drive-transmitting connection between the pressure roller and third roller.

A further object of the invention is to provide an improved selective control mechanism for a weft feed mechanism of the aforedescribed character which accurately controls motion of the pressure roller and another roller with respect to the feed roller in dependence on the corresponding weft pattern signal.

BRIEF DESCRIPTION OF THE DRAWINGS

Other objects, features and advantages of the invention will be apparent as the following explanation of a preferred embodiment of the invention proceeds, with reference to the accompanying drawings, in which like reference numerals indicate like and similar parts throughout several figures and wherein.

DESCRIPTION OF THE PREFERRED EMBODIMENTS

Represented by 10 is a weft feed roller of a relatively large diameter, which is at its boss 12 fastened or screwed to a rotary shaft 14 driven from any convenient loom shaft (not shown) for rotation in synchronism with weaving cycle of loom.

Figure 1:
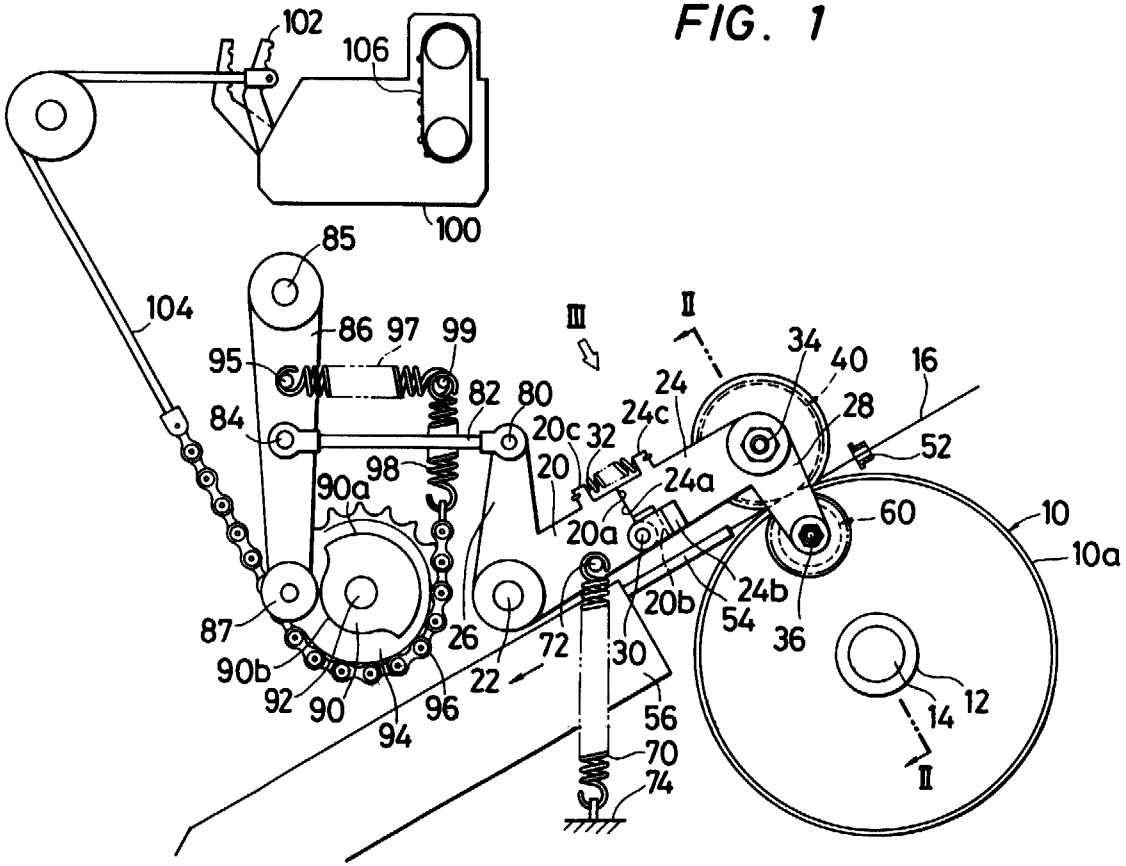
FIG. 1 is a schematic plan view of a weft feed mechanism according to a single preferred embodiment of the invention with a pressure roller in the operative position.
Figure 3:
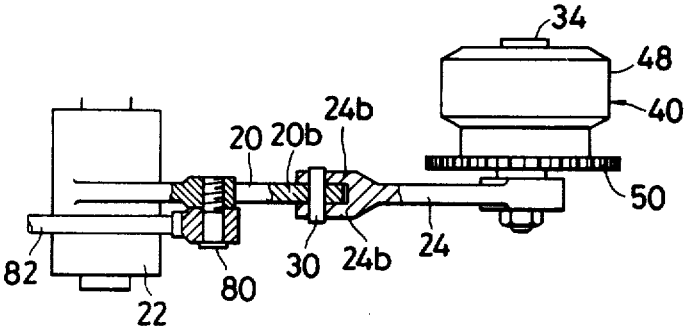
FIG. 3 is an elevation viewed in the direction indicated by an arrow in FIG. 1.

An angled lever 20 is at its elbow rockably mounted on a fixed shaft 22 provided in parallel with the rotary shaft 14. Another angled lever 24 which is located oppositely to the aforementioned lever 20 abuts at its one end 24*a* against the adjacent end 20*a* of the angled lever 20. The two levers 20, 24 in rest position are thus generally in alignment with each other with their arms 26, 28 oppositely directed as illustrated in FIG. 1. As best seen in FIG. 3, the two levers 20, 24 are joined together in a manner that a projection 20*b* formed at the end 20*a* of the lever 20 is gripped by a fork 24*b* at the end 24*a* of the lever 24 and is transversely passed by a pivot pin 30 together with the fork 24*b*. Above this joint portion in FIG. 1, the two levers 20, 24 are respectively formed with lugs 20*c*, 24*c* which are bridged by tension spring 32. The spring 32 thus biases the lever 24 in counter-clockwise direction in FIG. 1 so that the two levers may swing bodily together in close contact with each other. On the other hand, the levers are able to limitedly pivotally displace relative to each other about the pivot pin 30 against the spring 32, as will be later explained.

Figure 2:
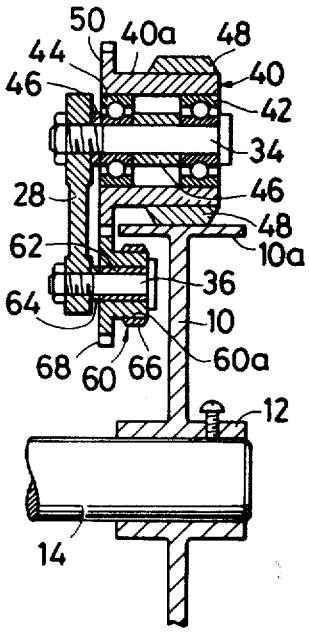
FIG. 2 is a section taken along the line II—II of FIG. 1.
Figure 5:
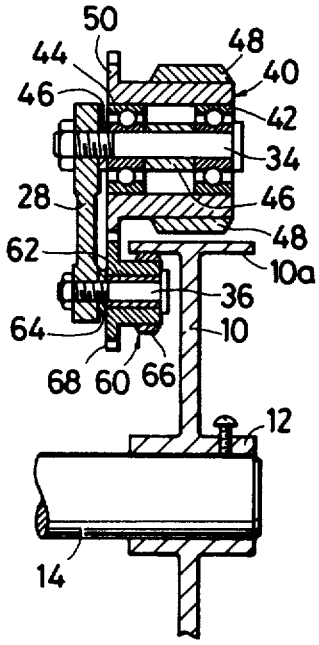
FIG. 5 is a section taken along the line V—V of FIG. 4.

The carrier arm 28 depends generally at right angle from the lever 24 and extends in parallel with the roller 10 at a certain axial distance therefrom inwardly beyond the outer periphery of the roller 10. Carried by the carrier arm 28 are two spindles 34, 36 fastened to the top and bottom ends thereof. Relative position of the feed roller 10 and the spindles is therefore such that a brim 10*a* of the feed roller is disposed intermediate between the spindles 34 and 36 as seen in FIG. 2. The pressure roller 40 is mounted on the upper spindle 34 freely rotatably by means of two ball type bearings or the like 42, 44. Represented by 46 are spacers for providing spaces respectively between the two bearings 42, 44 and between the bearing 44 and carrier arm 28.

The outer surface 40*a* of the pressure roller 40 engageably faces the feed roller 10 and is wrapped by a rubber ring 48 providing an operating friction surface when engaged with the feed roller 10. The axial end of the roller 40 outside of the feed roller 10 is integrally formed with a pinion or gear 50 for the purpose that will be apparent later. FIG. 1 illustrates that the pressure roller 40 is in pressure engagement with the feed roller 10 so that the weft yarn 16 delivered from a source of weft (not shown) through a guide 52 is gripped between and driven by the two rollers 10, 40 to reach a tubular guide 54 of a weft storage tube 56.

Also the lower spindle 36 rotatably carries a roller 60. Specifically, the roller 60 is mounted on a bushing 62 onto which the spindle 36 is pressed. An end of the spindle 36 is fastened to the carrier arm 28 by a nut via a spacer 64. The outer surface 60*a* of the roller is encircled by a rubber ring 66 and is engageable opposite to the inner surface of the brim 10*a*. The axial end of the roller 60 outside of the feed roller 10 is also formed with pinion 68 which is in constant mesh with the pinion 50 on the pressure roller. Gear ratio of the pinions 50, 68 is so determined that the peripheral velocity of the pressure roller 40 in the inoperative position where the roller 60 engages the roller 10 is substantially equal to the peripheral velocity of the feed roller 10.

The angled lever 20 is biased in clockwise direction in FIG. 1 about the fixed shaft 22 by means of a spring 70 which is borne at one end by a pin 72 planted on the lever 20 and at the other fixed to a stationary part 74 of the mechanism. The end of the lever 20 opposite to the end 20*a* is further formed with a fixed stud 80 on which a link rod 82 is pivotally mounted. The other end of the link rod 82 is also pivotally mounted on a pin 84 planted on the intermediate portion of a cam lever 86 that will be further mentioned.

Indicated by numeral 90 is a cam rotatably mounted on a fixed cam shaft 92. The cam 90 has a raised surface 90*a* and a lowered surface 90*b* of the shape as illustrated. A sprocket wheel 94 is mounted on the cam shaft 92 concentrically and integrally with the cam 90 so that the cam 90 and the sprocket wheel 94 rotate together. Around the sprocket wheel is wrapped a chain 96, one end of which is retained by a spring 98 hung on a fixed pin 99. The other end of the chain 96 is connected, for instance, with a shedding lever 102 of a dobby mechanism 100 that will be explained later by means of a rope or cable 104.

Engageable with the cam 90 is a circular cam follower 87 carried by the cam lever 86 which is rockably mounted on a fixed cam lever shaft 85. The cam lever 86 is constantly biased in counter-clockwise direction in FIG. 1 by means of a spring 97 having one end hung on a pin 95 fastened to the cam lever and the other end hung on the pin 99 together with spring 98.

Camming action of the cam 90 and follower 87 thus causes rocking movement of the cam lever 86, which is transferred to the angled lever 20 via link rod 82 for swinging movement of the lever 20. It would be readily seen that the swinging movement of the lever 20 together with the lever 24 results in limited reciprocal motion of the carrier arm 28.

The dobby mechanism 100 is of the known type which is provided with a pattern card arrangement 106 carrying the desired weft pattern signals, in accordance with which shedding motion is controlled. As usual, multiple shedding levers are provided, one for each heald (not shown), to be able to form a number of warp sheds corresponding to variegated and complicated weft patterns. Usual weaving operation, however, seldom employs all of the shedding levers and some of the levers remain unused in most cases. In the illustrated embodiment, the extra shedding levers 102 which are not in use for shedding operation are exploited to control the operation of the weft feed mechanism. That is, the ropes 104 for driving the chain 96 and therefore the sprocket wheels 94 are connected with the extra shedding levers as previously described.

The feed mechanism constructed as above operates in a manner hereinafter described. As weft pattern signal selected by the pattern card arrangement indicates feeding of the weft 16 in FIGS. 1 and 4, the shedding lever 102 swings in clockwise direction in the drawings thus withdrawing the rope 104. The chain 96 is then pulled up against the spring 98, whereupon the sprocket wheel 94 and therefore the cam 90 rotate in clockwise direction. The cam then at its lowered surface 90*b* engages the cam follower 87 as shown in FIG. 1. The cam lever 86 is thus rotated about the shaft 85 in counter-clockwise direction. This angular movement of the cam lever 86 is transferred to the angled lever 20 by way of the link rod 82 and causes the angled lever 20 to swing in clockwise direction about the fixed shaft 22 with the aid of the spring 70. The angled lever 24 is kept abutting at its end face against the corresponding end of the angled lever 20 by the action of the spring 32 so that both levers bodily swing in clockwise direction. It follows that the rubber ring 48 of the pressure roller 40 in the operative position is pressed against the feed roller 10.

The weft yarn 16 gripped between the rubber ring 48 and the outer surface of the feed roller 10 is driven by a suitably measured length and is delivered to the storage tube 56 through the tubular guide 54. When the stored weft yarn reaches a predetermined length, the weft yarn is inserted into the selected shed by means of the non-illustrated weft insertion device.

The roller 60 is in this instance away from the inner surface of the roller 10 and is driven from the pressure roller 40 through the pinions 50 and 68.

Subsequent length of the same weft yarn 16 is measured and fed to the storage tube in a similar manner.

Figure 4:
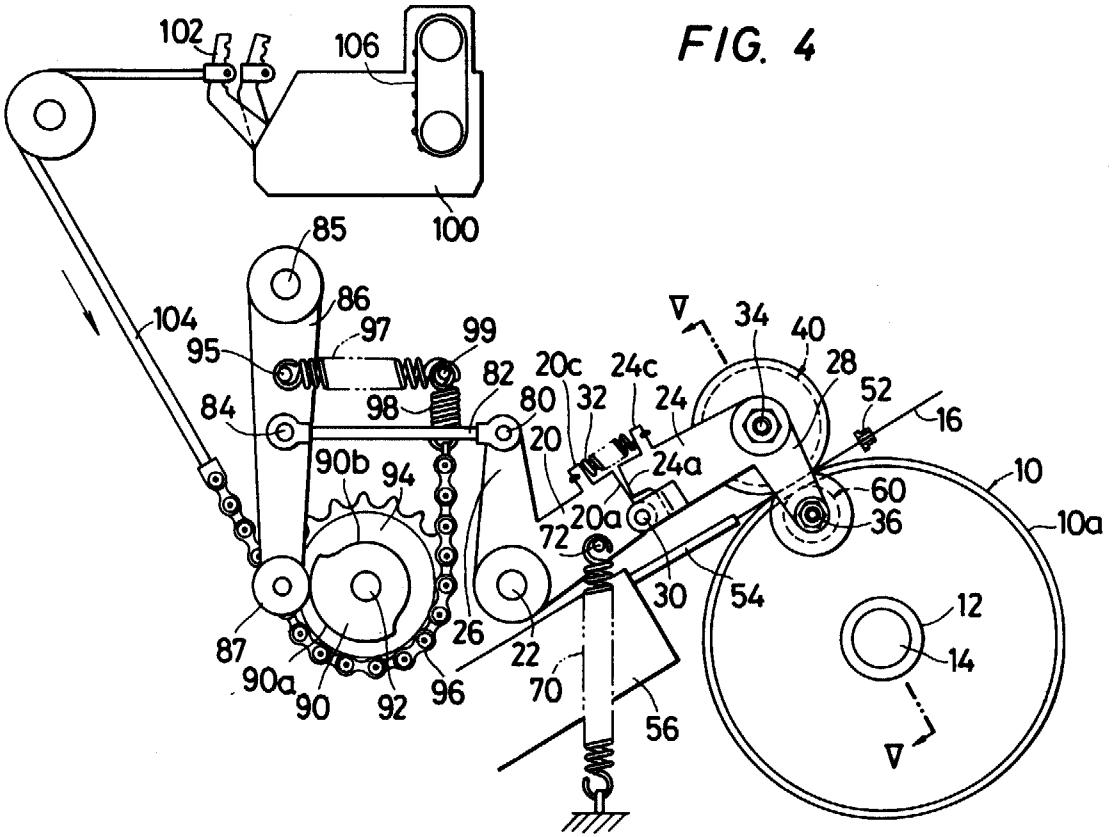
FIG. 4 is a view similar to FIG. 1 but showing the pressure roller in the inoperative position.

When another weft yarn is then selected, the shedding lever 102 is moved leftwardly as in FIG. 4. Consequently, the rope and chain are allowed to be pulled in the arrow-indicated direction by the action of the spring, rotating the sprocket wheel 94 in counter-clockwise direction. The raised surface 90*a* of the cam 90 now engages the cam follower 87. The cam lever 86 then rocks about the shaft 85 in clockwise direction; and angled lever 20 limitedly swings about the shaft 22 in counter-clockwise direction. The lever 24 also swings in the same direction together with the lever 20, whereupon the roller 40 disengages from the outer surface of the roller 10 assuming the rest or inoperative position. The weft yarn 16 is relieved from the pressure of the roller 40; measuring and feeding motion of the corresponding mechanism is thus terminated.

On the other hand, the roller 60 is now brought into engagement with the inner surface of the brim 10*a* with rising movement of the carrier arm 28 due to bodily swinging movement of the levers 20 and 24. As soon as this engagement takes place, the lever 24 can no longer swing about the shaft 22 with the lever 20 and is angularly displaced relative to the lever 20 about the pivot pin 30 against the action of the spring 32. The tension of the spring 32 keeps the roller 60 in resilient contact with the inner surface of the brim 10*a*. The pressure roller 40 apart from the feed roller 10 is thus driven by the roller 60 through pinions 68, 50 generally at the same peripheral velocity as in its direct engagement with the roller 10.

When the weft 16 is again selected after insertion of some other wefts in accordance with pattern signals, the pressure roller 40 is again brought into direct contact with the roller 10 in a manner previously explained. Since the pressure roller 40 in the inoperative position has continued to rotate as described above, it therefore can be smoothly synchronized with the roller 10, thus stably driving the weft.

To more dependently eliminate a slip between the yarn and the pressure roller for the initial period of driving operation, it is preferable to so select the gear ratio of the pinions 50, 68 that the peripheral velocity of the pressure roller 40 in the inoperative position where the roller 60 engages the roller 10 is somewhat larger than the peripheral velocity of the roller 40 in the operative position. The pressure roller 40 thus driven at an enhanced speed surely grips the weft and can drive it at the preset speed in the initial stage of driving operation.

What is claimed is:

1. In a shuttleless weaving loom a weft inserting device;

a weft selector for selecting a weft yarn to be inserted into a warp shed, almongst a plurality of yarns in accordance with a predetermined weft pattern and producing a signal indicative of the selected weft yarn;

a plurality of weft drive devices, one for each of said weft yarns, for driving the weft yarns to said weft insertion devices, each of said weft drive devices including:

a feed roller constantly driven by a shaft which rotates in synchronism with the weaving cycle of said loom;

a pressure roller;

means having a lever on which said pressure roller is rotatably mounted and which is responsive to said signal for moving said lever toward said feed roller to bring said pressure roller into contact with the outer periphery of said feed roller; and another roller carried on said lever which is in drive connection with said pressure roller and disposed opposite the inner periphery of said feed roller so as to be held out of contact with said inner periphery when said pressure roller is brought into contact with the outer periphery of said feed roller and brought into contact with said inner periphery when said pressure roller is held out of contact with said outer periphery of said feed roller.

2. A shuttleless weaving loom comprising:

a weft insertion means;

a weft selector means for selecting a weft to be inserted into a warp shed among a plurality of weft yarns in accordance with a desired weft pattern and producing a signal indicating the selected weft yarn;

a weft drive means, one for each weft yarn, for driving the weft yarns to said weft insertion means, each said weft drive means including a feed roller constantly driven by a shaft rotated in synchronism with a weaving cycle of the loom;

a pressure roller arranged to be brought into and out of pressure engagement with said feed roller, said feed roller and said pressure roller having the weft yarn therebetween;

another roller adapted to be driven by said feed roller in accordance with separation of said pressure roller from said feed roller, said another roller being disposed in opposition to the inner periphery of the feed roller for rolling engagement therewith;

means for drive transmitting connection between said pressure roller and said another roller, and selective control means operatively connected with said pressure roller and with said another roller for controlling movement of said rollers in dependence on said signal for pressure engagement of said pressure roller with said feed roller while separating the pressure roller form said feed roller in the absence of said signal.

3. A shuttleless weaving loom as defined in claim 2, comprising a reciprocally movable carrier arm fixedly carrying two spaced parallel spindles, between which a brim of said feed roller is disposed, one of said spindles rotatably carrying thereon said pressure roller and the other of said spindles rotatably carrying thereon said another roller.

4. A shuttleless weaving loom as defined in claim 3, wherein said means for drive transmitting connection comprises pinions respectively connected to said pressure roller and said another roller in constant mesh with each other.

5. A shuttleless weaving loom as defined in claim 4, in which the gear ratio of said pinions is determined that the peripheral velocity of the pressure roller in the inoperative position is substantially larger than the velocity of the pressure roller in the operative position.

6. A shuttleless weaving loom as defined in claim 3, in which said selective control means comprises a cam rotatably mounted on a cam shaft, a sprocket wheel mounted on the cam shaft concentrically and integrally with said cam, a chain wrapped around the sprocket wheel and having one end connected with said weft selector means for rotation of the cam in accordance with said signal, a cam lever having one end carrying a cam follower and being rockable about a fixed shaft in dependence on engagement and disengagement of the cam follower with surface of said cam, an oscillatory lever linked with rocking movement of said cam lever, and connecting means for operative connection of the oscillatory lever with carrier arm.

7. A shuttleless weaving loom as defined in claim 6, in which said connecting means comprises a lost motion connection including means biasing the oscillatory lever and the carrier arm toward each other.

8. A shuttleless weaving loom as defined in claim 2, in which said weft selector means comprises a dobby mechanism including thereon a pattern card arrangement carrying thereon said weft pattern signals, and a plurality of shedding levers operable in accordance with said weft pattern signals each forming a shed by a group of warps corresponding to the selected weft to be inserted, and in which said selective control means is operatively connected with a part of the shedding levers for controlling the weft drive means.

* * * * *